US005927833A

United States Patent [19]

Kelley

[11] Patent Number: 5,927,833

[45] **Date of Patent: *Jul. 27, 1999**

[54] CONCEALED DESK

[76] Inventor: James O. Kelley, P.O. Box 222, Grand Haven, Mich. 49417

[ * ] Notice: This patent is subject to a terminal disclaimer.

[21] Appl. No.: 08/929,346

[22] Filed: Aug. 27, 1997

Related U.S. Application Data

[63] Continuation-in-part of application No. 08/428,530, Apr. 25, 1995, Pat. No. 5,678,905, which is a continuation-in-part of application No. 29/007,733, May 3, 1993, Pat. No. Des. 357,599, and a continuation-in-part of application No. 29/037,658, Apr. 17, 1995, Pat. No. Des. 376,491, and a continuation-in-part of application No. 29/037,654, Apr. 17, 1995, Pat. No. Des. 376,496.

[51] Int. Cl.[6] ..... A47B 17/00

[52] U.S. Cl. ..... 312/196; 312/262; 312/291; 312/223.3; 312/326

[58] Field of Search ..... 312/196, 258, 312/262, 194, 223.3, 326, 291; 140/210, 213

[56] References Cited

U.S. PATENT DOCUMENTS

| | | | |
|---|---|---|---|
| D. 357,599 | 4/1995 | Kelley | D6/439 |
| D. 376,491 | 12/1996 | Kelley | D5/439 |
| D. 376,496 | 12/1996 | Kelley et al. | D6/446 |
| 654,922 | 7/1900 | Schipkowsky | 312/298 X |
| 1,948,703 | 2/1934 | Fanarjian | 312/196 |
| 3,078,133 | 2/1963 | Schauer | 312/223 |
| 5,121,974 | 6/1992 | Monson | 312/194 |
| 5,678,905 | 10/1997 | Kelley | 312/196 |

*Primary Examiner*—Peter M. Cuomo
*Assistant Examiner*—Stephen Vu

[57] ABSTRACT

A concealed desk comprises a desktop or worksurface, with supporting side panels and a kneehole opening and storage compartments under the desktop. The front of the desk is enclosable by folding doors mounted on front side edges of the desk side panels. When the doors are opened, the doors preferably fold against the side panels of the desk and do not obstruct either the appearance or the use of the desk. The door facades are those of conventional doors and conceal the presence of a kneehole opening or storage compartments in the desk opening inside the doors. The desktop surface of the desk is concealed by an upper storage unit that is mounted on the desktop or that comprises an extension of the desk, above the desktop or worksurface. Doors may also enclose the top portion of the desk unit in the same manner as the doors on the lower portion, giving the furniture the appearance of a cabinet or a secretary. Full length doors may enclose both the upper and lower portions of the desk to give the furniture the appearance of an armoire.

21 Claims, 12 Drawing Sheets

CONCEALED DESK

CROSS-REFERENCES TO RELATED APPLICATIONS

This is a continuation in part application of U.S. patent application Ser. No. 08/428,530, entitled CONCEALED DESK and filed on Apr. 25, 1995, now U.S. Pat. No. 5,678,905, by James O. Kelley, the disclosure of which is incorporated here by reference, which is a continuation in part of applicant's patent applications: Ser. No. 29/007,733, entitled COMPUTER WORKSTATION and filed on May 3, 1993, now U.S. Pat. No. D 357,599, issued Apr. 25, 1995, the disclosure of which is incorporated here by reference; Ser. No. 29/037,658, entitled COMPUTER SECRETARY and filed on Apr. 17, 1995, now U.S. Pat. No. D 376,491, issued Dec. 17, 1996, the disclosure of which is incorporated here by reference; and Ser. No. 29/037,654, entitled COMPUTER WORKPLACE and filed on Apr. 17, 1995, now U.S. Pat. No. D 376,496, issued Dec. 17, 1996, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to a concealed desk in which the front of the desk is closed by doors that conceal the presence of a desk.

The presence of an office in the home is an increasing trend. A home office may be used for household finances or for doing business work at home. An increasingly popular use is for the operation of a computer in the home. Home offices typically include a desk, file storage, and drawer storage.

With a premium on space in most homes and apartments, it is not always possible to dedicate a room solely to a home office, and even when a room can be dedicate solely to a home office, it is commonly desired to give the home office a more homey appearance than conventional office furniture typically provides. For these reasons, it is desirable to incorporate a desk, storage compartments, and computer hardware into a furniture unit that can be closed to conceal the fact that the unit is actually a desk, and to conceal computer hardware, for example. A desk and accompanying storage compartments that are enclosable by doors to create the impression of a conventional home storage cabinet, buffet, or armoire, for example, and that are openable to provide a fully functioning desk are clearly desirable for the home office.

BRIEF SUMMARY OF THE INVENTION

In accordance with the present invention, a concealed desk comprises a desktop having side panels at side edges thereof that define a desk opening under the desktop. The desk opening includes a kneehole opening for sitting at the desk on a chair and one or more columns of storage or file compartments at one or more sides of the desk openings. The desk opening is enclosable by folding doors mounted on the desk side panels. When the doors are closed, the desk opening is covered by the doors. The door facades are those of conventional doors and belie the presence of a kneehole opening or storage compartments, and the desk opening inside the doors. The desktop surface of the desk is concealed by an upper portion of the furniture unit in the form of a storage unit or hutch that is mounted on the desktop or comprises an extension of the desk above the desktop work surface. The upper portion includes storage compartments, that are accessible from the front of the desk and include a recess for a desktop writing surface or for a computer monitor. Doors enclose the top portion of the desk unit in the same manner as the doors on the lower portion, giving the furniture the appearance of a home storage cabinet. Where the peripheral dimensions of the upper portion are the same as the lower portion, full length doors can enclose both the upper and lower portion, giving the furniture the appearance of an armoire, for example.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
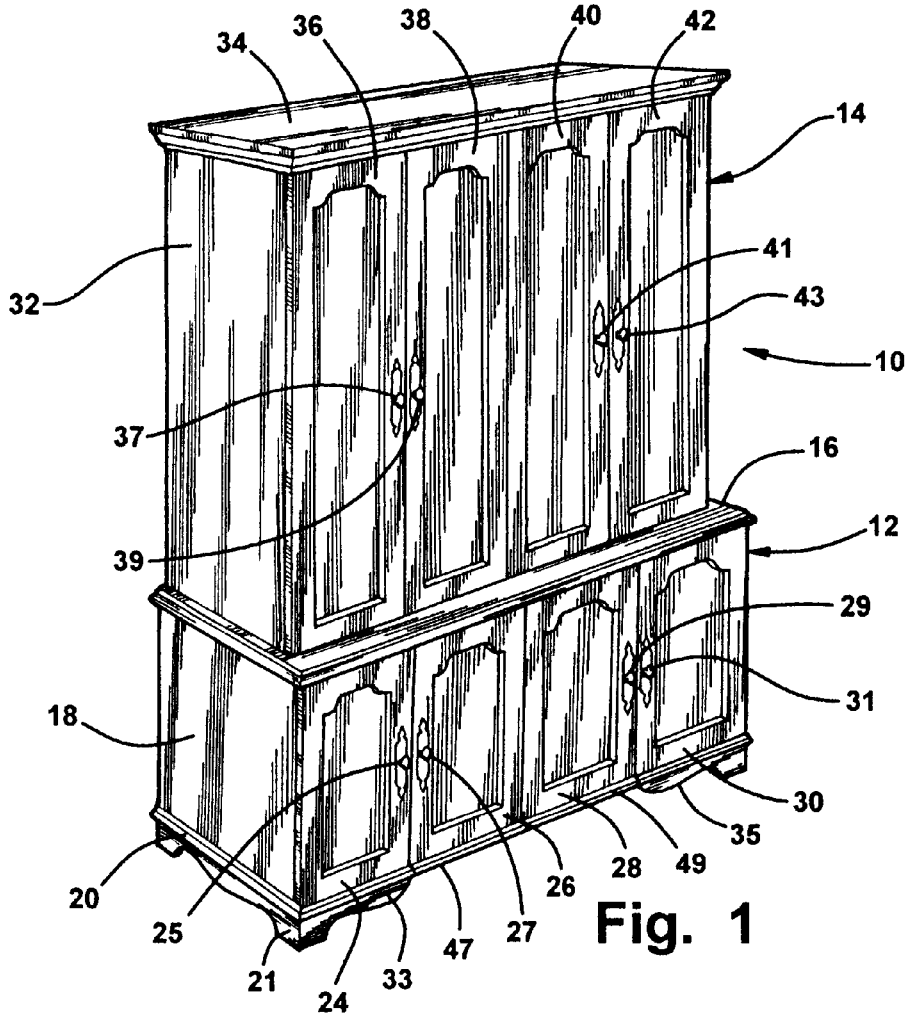
FIG. 1 is a front, left perspective view of a concealed desk according to the invention, in a closed position.
Figure 2:
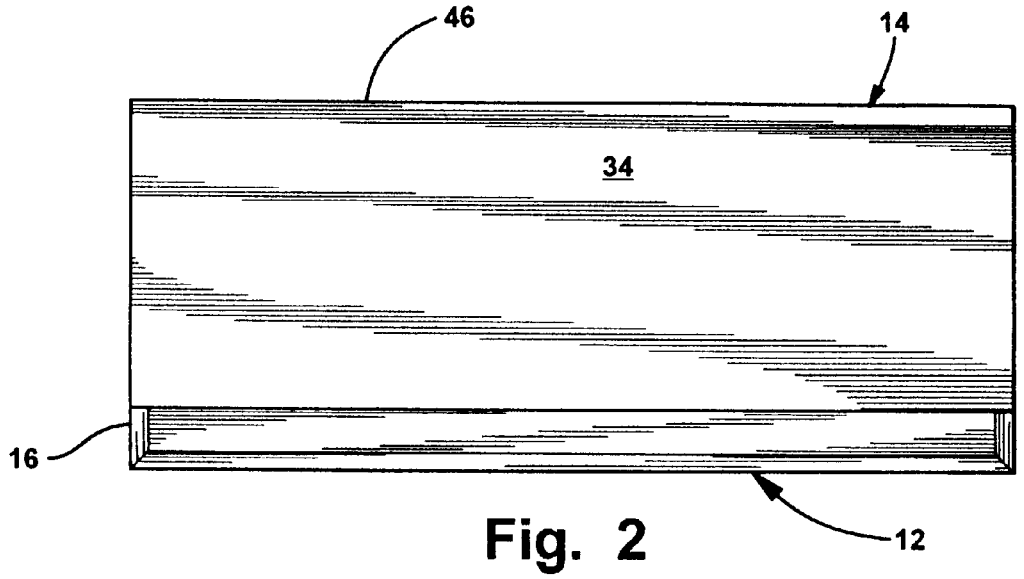
FIG. 2 is a top plan view thereof.

Referring to the drawings, a first embodiment of the invention, is generally shown in the drawing FIGS. 1–12 and identified with reference number 10. Concealed desk 10 comprises a lower desk unit 12 and an upper storage unit or hutch 14, mounted upon the desk unit 12. As shown in the drawings, a peripheral footprint of the storage unit 14 may be smaller than a surface of a top 16 of the desk 12.

The desk 12 comprises opposing side panels 18 at opposing ends of desktop 16. The side panels 18 extend between the desktop 16 and a supporting floor. A base molding 20 and feet 21 may be provided at the floor, as will be understood by one having ordinary skill in the art. The desk unit 12 also has a back panel 22 that extends across the back of the desk, below desktop 16. The front of the desk 12 is closed by four doors 24, 26, 28, and 30. The doors are shown in a closed position in FIG. 1. A facade of the doors 24, 26, 28, and 30 suggest that they are four typical doors that open with handles 25, 27, 29, and 31, respectively, and appear to cover storage compartments under the desktop 16. Further, lower portions 33 and 35 of the doors 24 and 30, respectively, appear to be conventional, fixed position feet and lower cross panels, while lower portions 47 and 49 of doors 26 and 28, respectively, appear to be part of the base molding 20, extending around an outer edge of a floor of the cabinet, including across the width of the cabinet, under the doors. These lower components are actually components of the door panels 24, 26, 28, and 30, however, and pivot open with the door panels.

The upper storage unit 14 has an appearance that is similar to the desk 12, excepting that the upper storage unit is taller than the desk. Upper storage unit 14 includes side panels 32 and a top 34. Doors 36, 38, 40, and 42 close a front of the storage unit 14. Handles 37 and 39 are provided adjacent to where the doors 36 and 38 abut each other. Handles 41 and 43 are provided on doors 40 and 42, adjacent to abutting edges of these doors. Thus, the facades of the doors 36, 38, 40, and 42 and the door hardware give an impression that the doors 36 and 42 open outward to the sides of the cabinet, while doors 38 and 40 are mounted to pivot inward.

Figure 3:
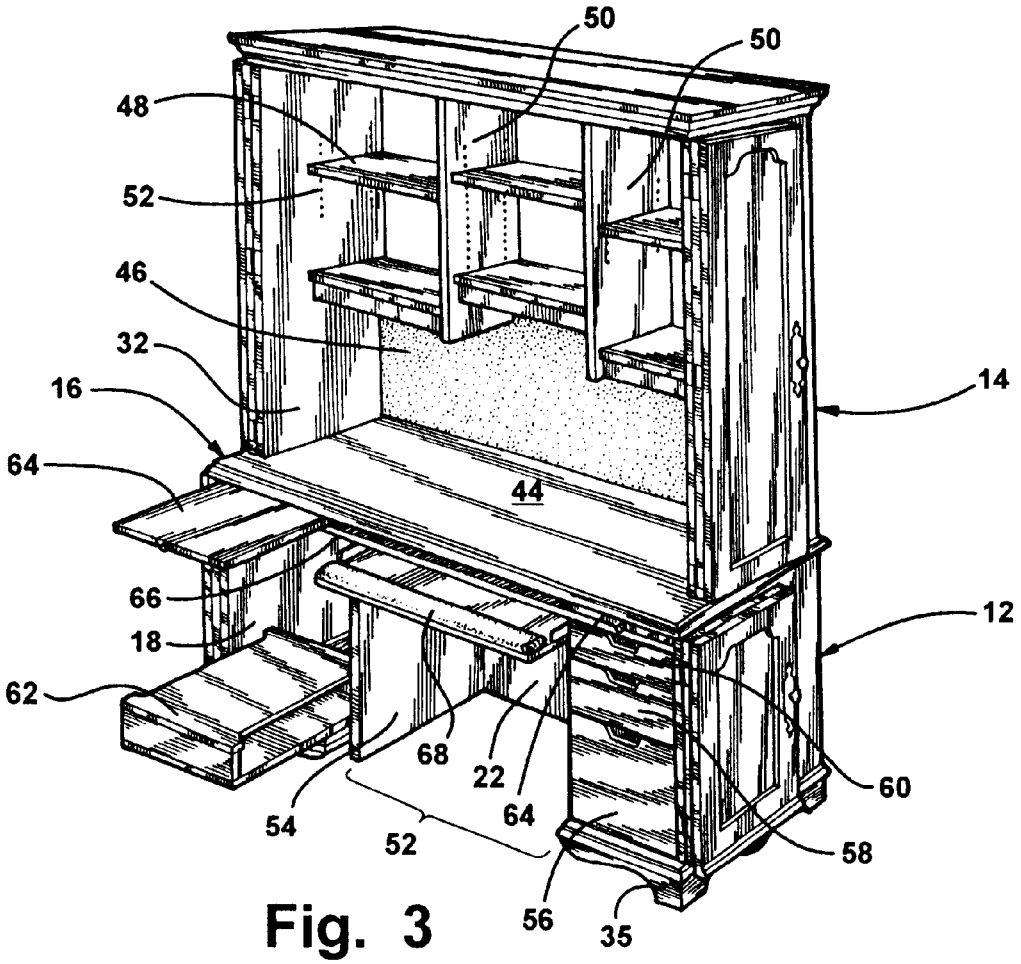
FIG. 3 is a front, right perspective view thereof, in an open position.
Figure 4:
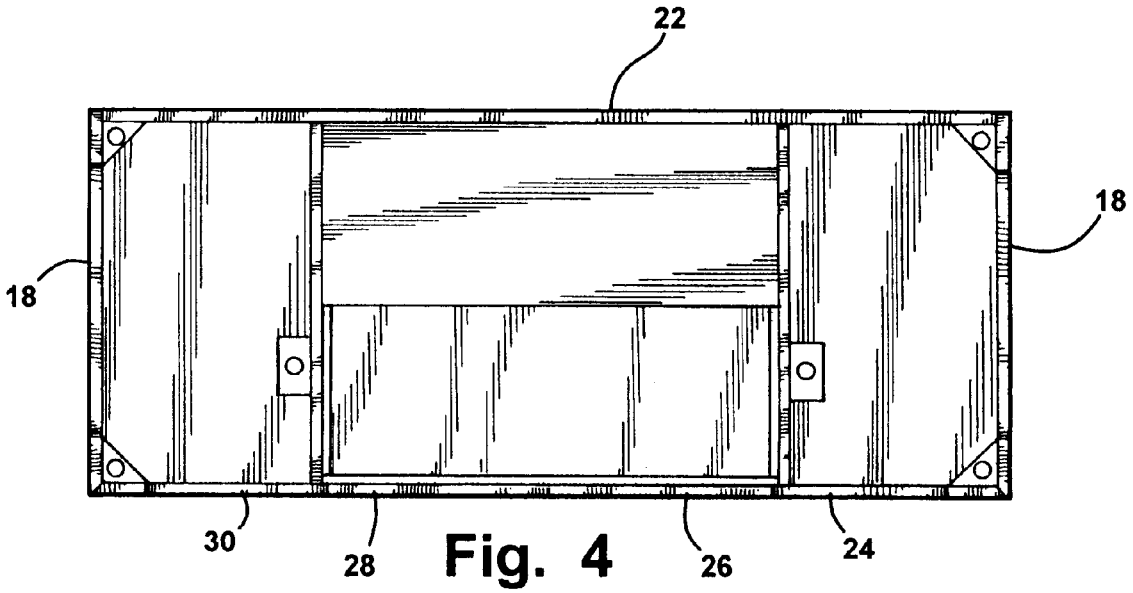
FIG. 4 is a bottom plan view thereof, in the closed position.
Figure 5:
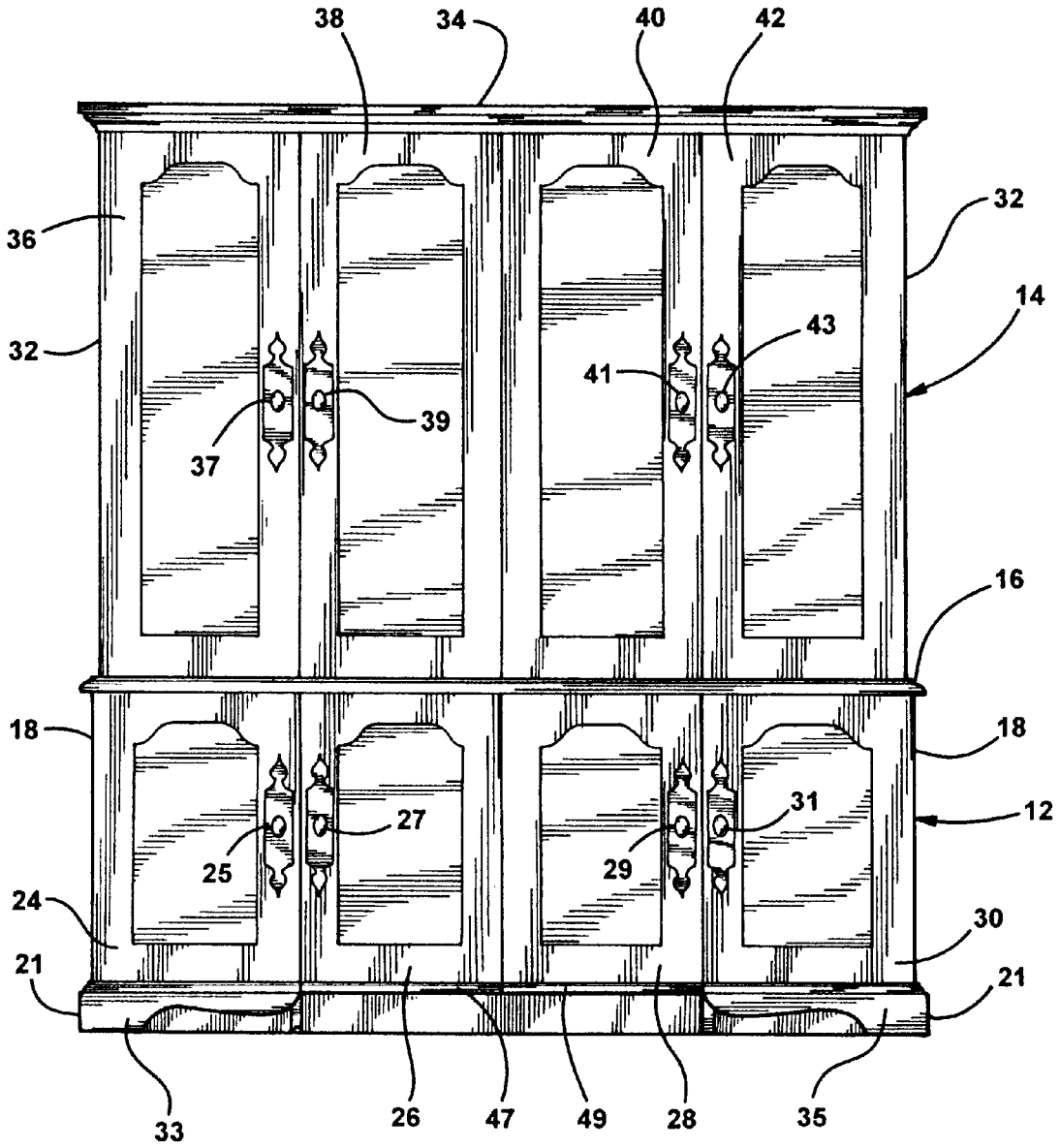
FIG. 5 is a front elevational view thereof.
Figure 6:
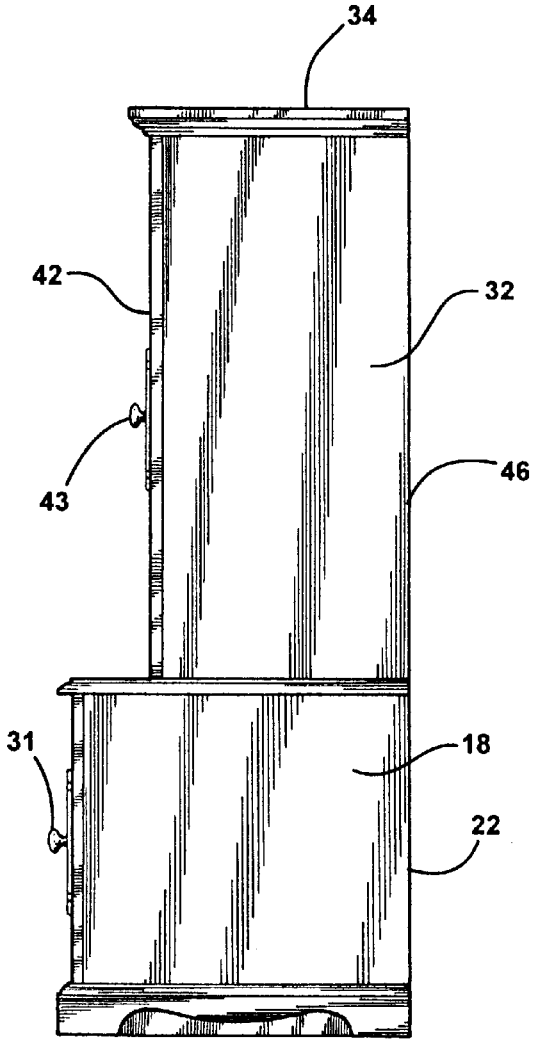
FIG. 6 is a right side elevational view thereof.
Figure 7:
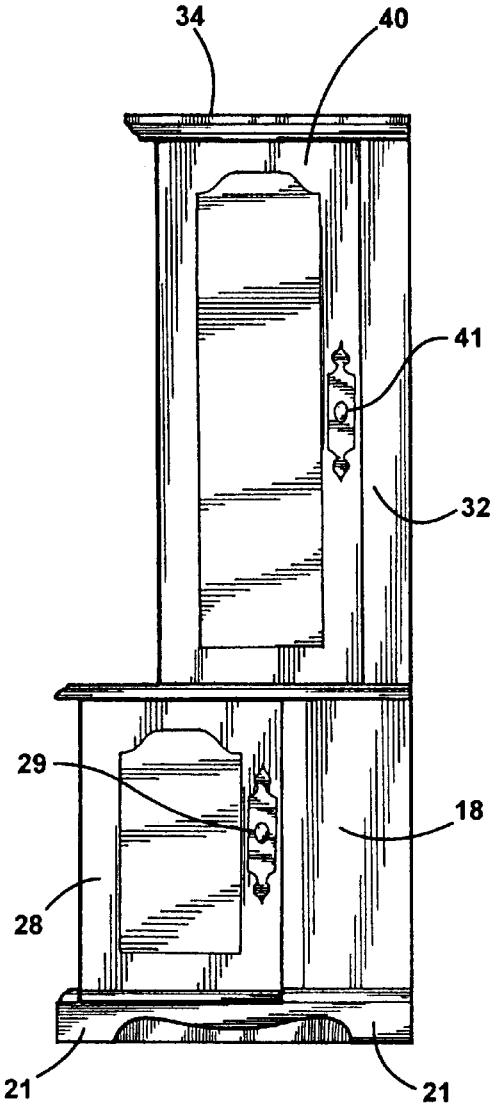
FIG. 7 is the view of FIG. 6 in the open position.
Figure 8:
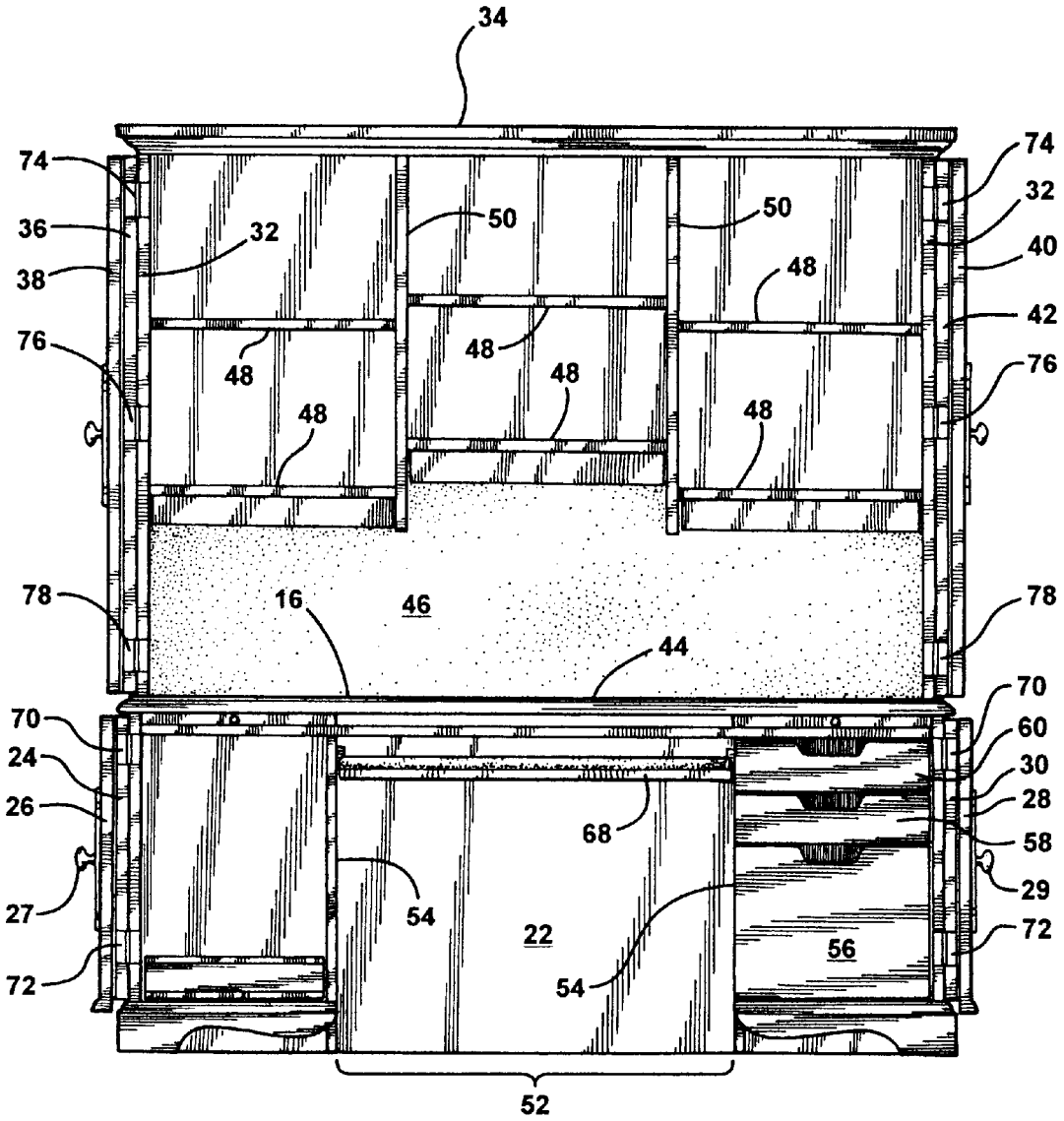
FIG. 8 is a front elevational view thereof.
Figure 9:
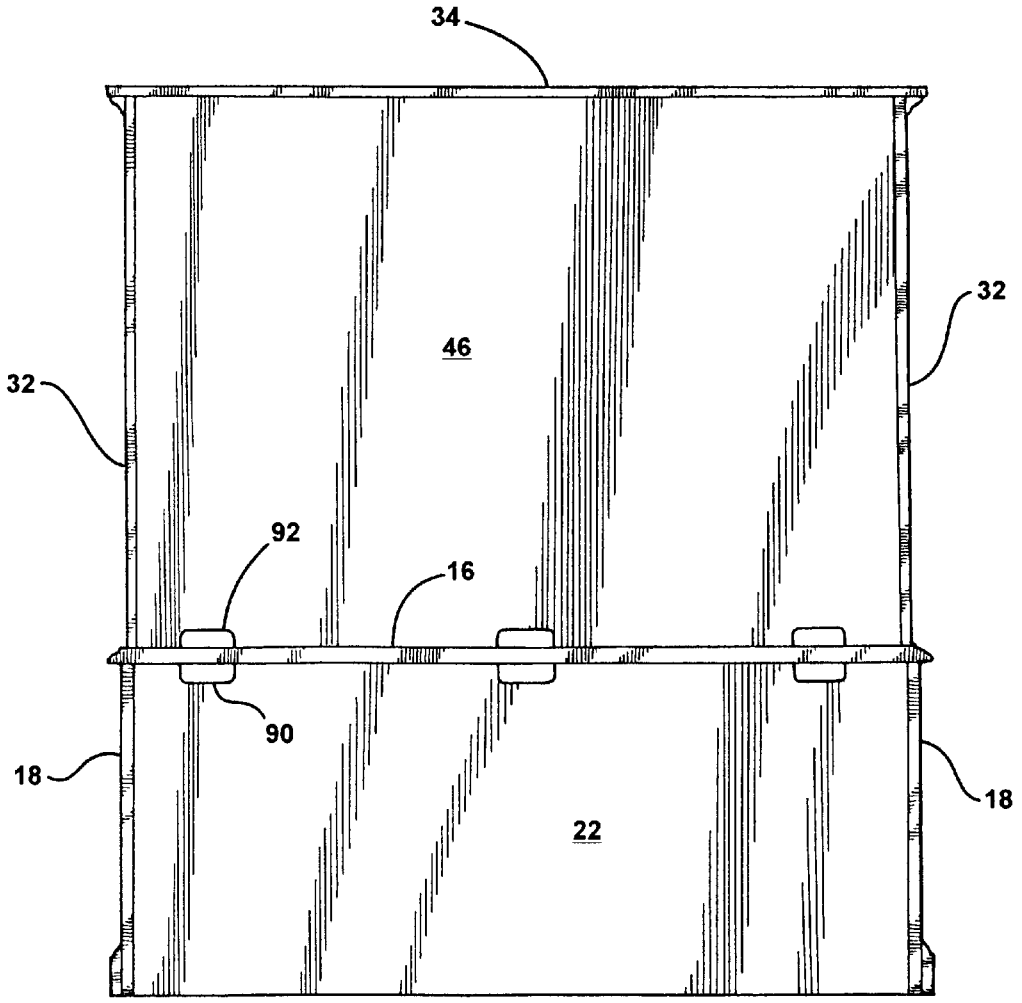
FIG. 9 is a rear elevational view thereof, in the closed position.
Figure 10:
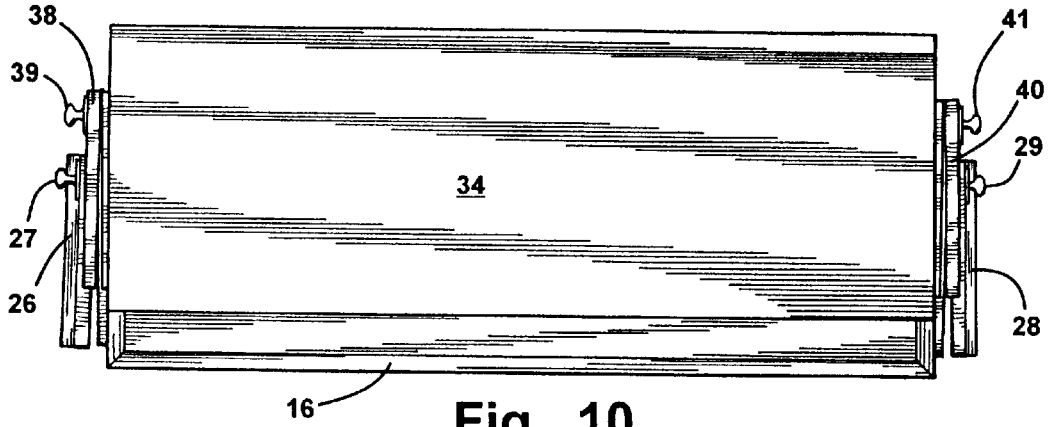
FIG. 10 is a top plan view thereof, in the open position.
Figure 11:
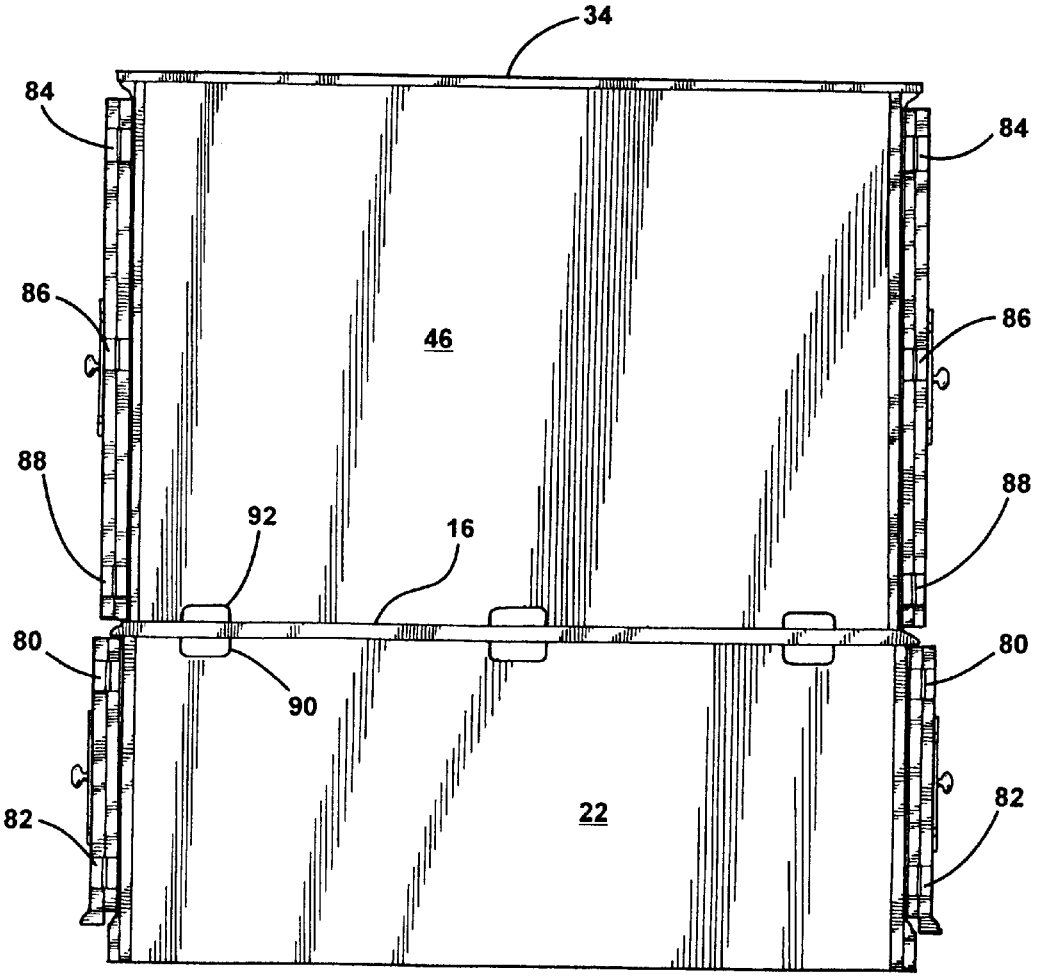
FIG. 11 is a rear elevational view thereof.
Figure 12:
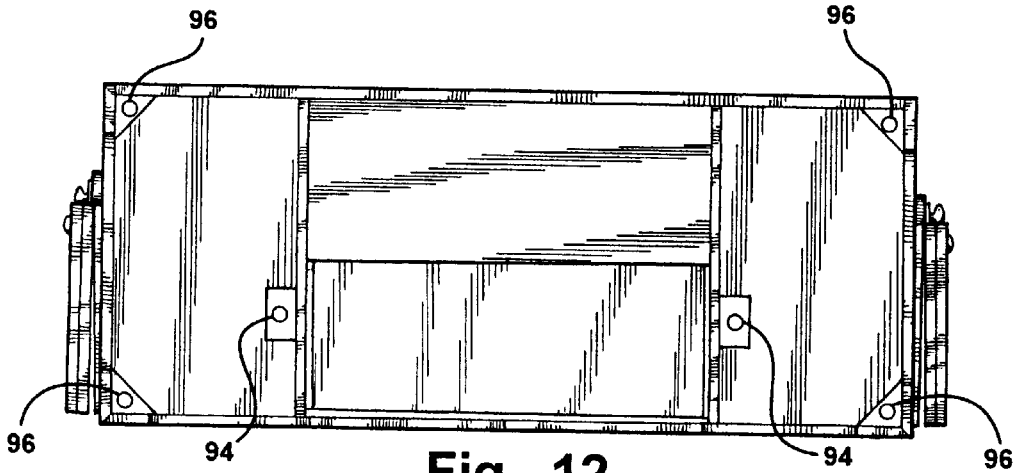
FIG. 12 is a bottom plan view thereof.

As shown in FIGS. 3 and 8, cabinet 10 may house unconventional storage compartments that would not be present in a conventional cabinet. Rather, the interior houses a fully functional desk 12 and storage units, including a computer desk, for example. The desk 12 has a writing surface 44, which may also support a computer monitor, for example, that extends fully across the desktop 16, between side panels 32 of the upper storage unit 14 and the full depth of the desk 12, between the front edge of the desktop 16 to a back panel 46 of the upper storage unit. An inner surface of the back panel 46 may be constructed with a cork or other material that will serve as a tack board, for example. Shelves 48 may also be positioned between the side panels 32 and a pair of intermediate vertical support panels 50 to create three columns of shelves in the interior of the upper storage compartment. The shelves 48 may be adjustable with spaced vertical openings 52 in the support panels, using conventional mounting hardware, as will be understood by one having ordinary skill in the art.

The desk unit 12 also has a kneehole space 52 beneath the desktop 16 and between the side panels 18, so a user may sit at the desk 12 just as with a conventional desk. Inner vertical panels 54 at each side of the kneehole space provide inner support for a file drawer 56 and box drawers 58 and 60 on the right hand side of the desk 12 (FIG. 3) and provide support for a slide out printer drawer 62 on the left hand side of the desk. Slide out work surfaces 64 may be mounted at the left and right hand sides of the desk 12, between a panel 66 and the underside of desktop 16. An extendable keyboard tray 68 may be mounted under the panel 66, in the kneehole opening area of the desk. One will notice that the doors 24, 26, 28, and 30 open to reveal unobstructed access in the kneehole 52.

The manner in which the doors most preferably open is shown in FIGS. 3, 8, 10, 11, and 12. Outer doors 24 and 30 of the desk unit 12 are hinged to front edges of side panels 18 by upper and lower hinges 70 and 72. Outer doors 36 and 42 of the upper storage unit 14 are hinged on front edges of side panels 32 by hinges 74, 76, and 78 at the upper end, middle, and lower end of the doors, respectively. The outer door panels 24 and 30 of the desk unit 12 and the outer door panels 36 and 42 of the upper storage unit 14 fold against the side panels 18 and 32 of the desk unit and upper storage unit, in the manner shown in FIGS. 3, 8, and 10–12.

Inner door panels 26 and 28 of the desk unit 12 are pivotally connected to outer doors 24 and 30, respectively, by hinges 80 and 82 (FIG. 11), so that inner surfaces of doors 26 and 28 pivot into abutment with inner surfaces of doors 24 and 30. Thus, the doors fold conveniently and inconspicuously out of the way, against the side panels 18 of the desk unit 12 in an open position, when the desk 12 is opened to use as a desk.

In a similar manner, inner doors 38 and 40 are pivotally attached to outer doors 36 and 42 of the upper storage unit 14 by hinges 84, 86, and 88 at the upper end, middle, and lower end of the upper storage unit doors, respectively. And, these doors also fold conveniently and inconspicuously out of the way, against the side panels 32 of the upper storage unit 14 in an open position, for access and use of the upper storage unit 14.

The back panels 22 and 46 of the desk and upper storage units, respectively, may include openings 90 and 92 that are spaced across the back panels to provide wiring access through the back panels. Wiring openings 94 and 96 may also be provided in the bottom of the desk 12 for wiring access, all as will be understood by one having ordinary skill in the art.

A second embodiment 100 of the invention is shown in drawing FIGS. 13–17. As shown, the concealed desk 100 has an appearance of a traditional sideboard, for example. Concealed desk 100 comprises a lower desk unit 102 and an upper hutch 104 upon desktop 106 of the desk unit 102. Hutch 104 is shown to have substantially the same width and depth as the desk unit 102, with a peripheral molding on the edge of top 106 extending outward beyond an outer periphery of the hutch 104 and desk 102.

Figure 13:
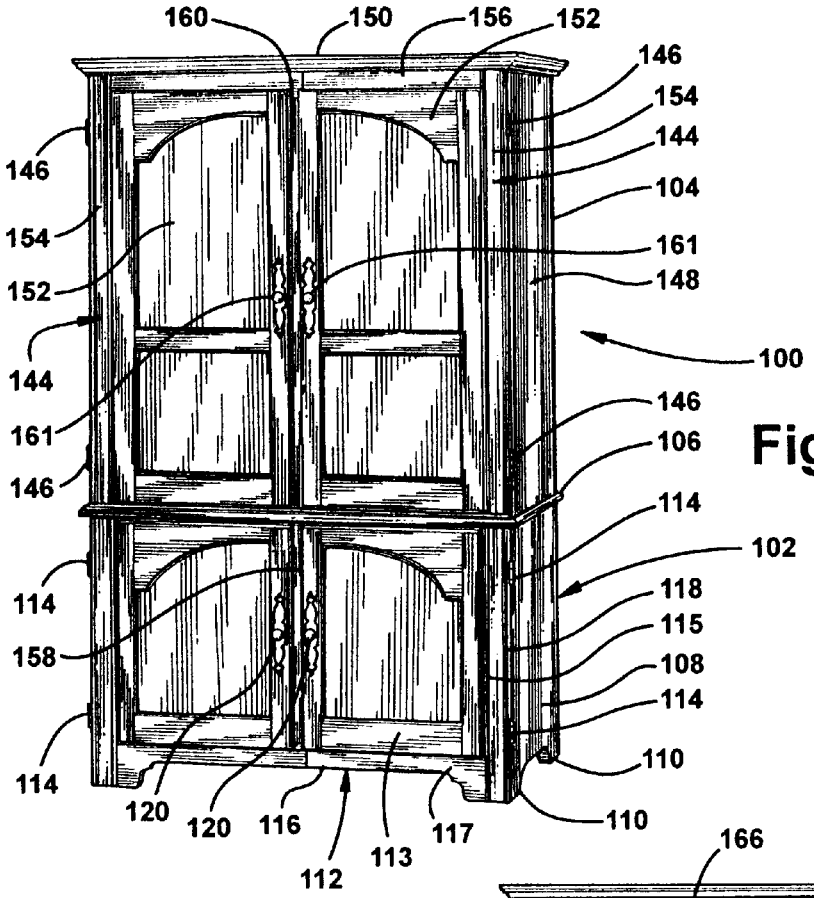
FIG. 13 is a front, right perspective view of a second embodiment of the invention, in a closed position.

Also as shown in FIG. 13, desk unit 102 comprises side panels 108 that extend downward to a supporting floor. Corner feet 110 may be provided at front and rear corners of the side panels 108. Doors 112 may be mounted with hinges 114, on front edges of the side panels 108. The doors 112 have an appearance of a separate door panel 113 with a side edge 115 spaced inward from a vertical side panel 118 that extends along a front edge of the side panel 108, and with a bottom edge 117 spaced above a transverse base panel 116 that extends across the width of the cabinet. The doors 112 also present an appearance that the doors 113 latch to a fixed position center strip 158. Thus, the facade of the lower door panels 112 deceptively present false doors 113 that appear to open into a conventional storage cabinet.

Notwithstanding the facade, however, the door panels 113, lower panels 116, vertical side panels 118, and center strip 158 all form the doors 112. Thus, the door panels 113, lower panels 116, vertical side panels 118, and center strip 158 all open with the doors 112 to reveal a kneehole opening 122, between side panels 108 and below desktop 106, and to provide full, unobstructed access to the desk 102, as shown in FIG. 14.

Figure 14:
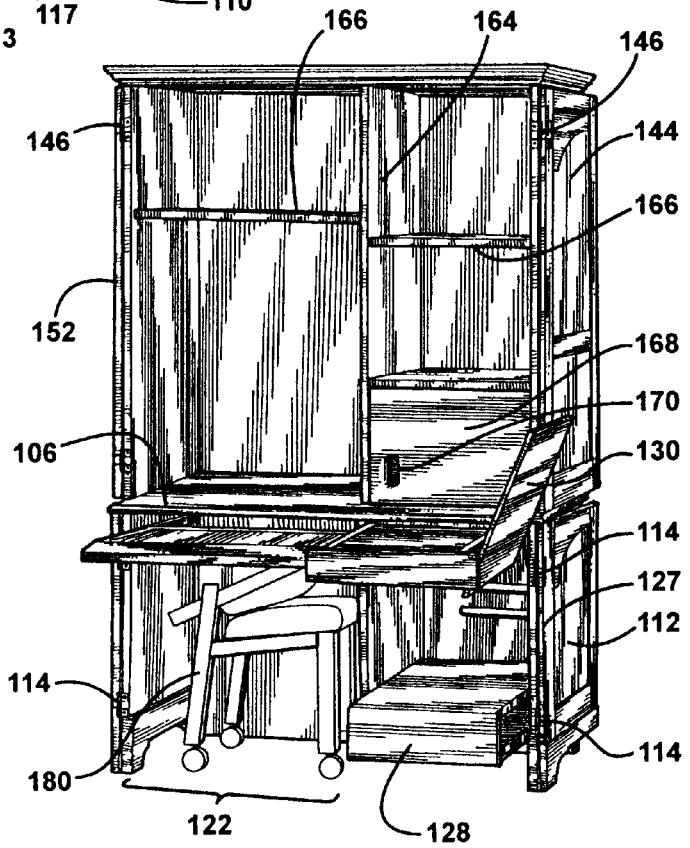
FIG. 14 is the view of FIG. 13 in an open position.
Figure 15:
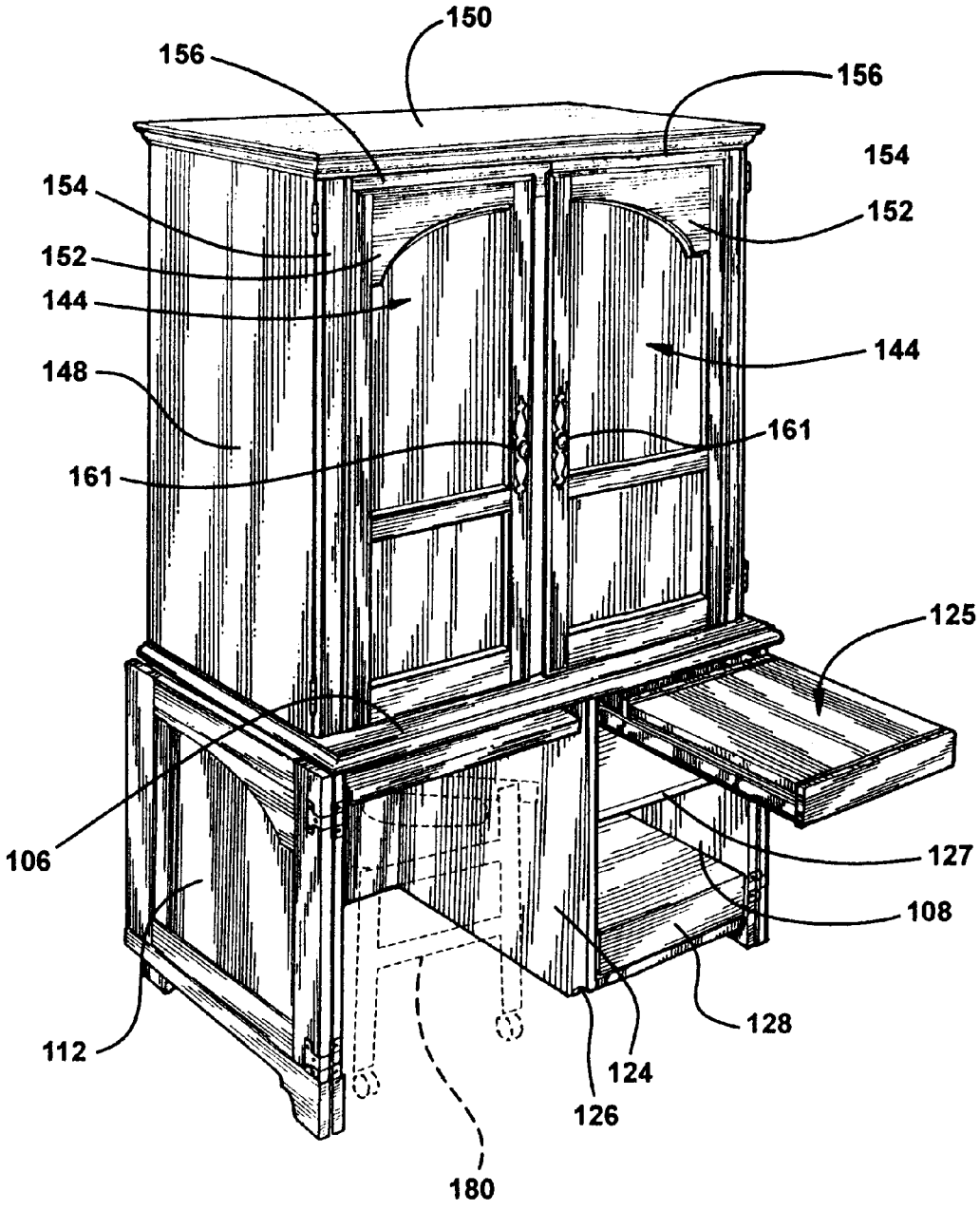
FIG. 15 is a front, left perspective view thereof, in a partially open position.
Figure 16:
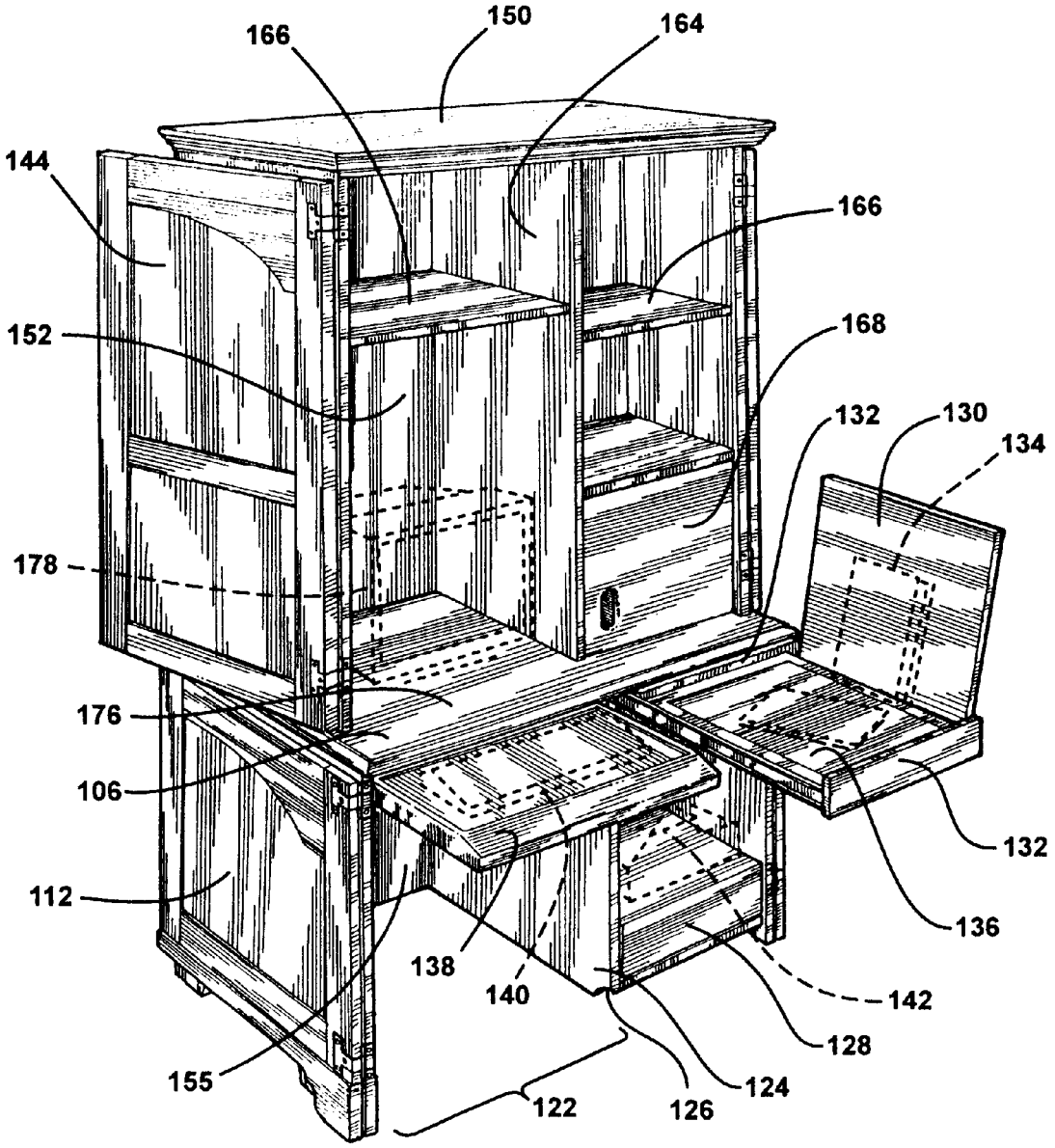
FIG. 16 is the view of FIG. 15, in the open position.
Figure 17:
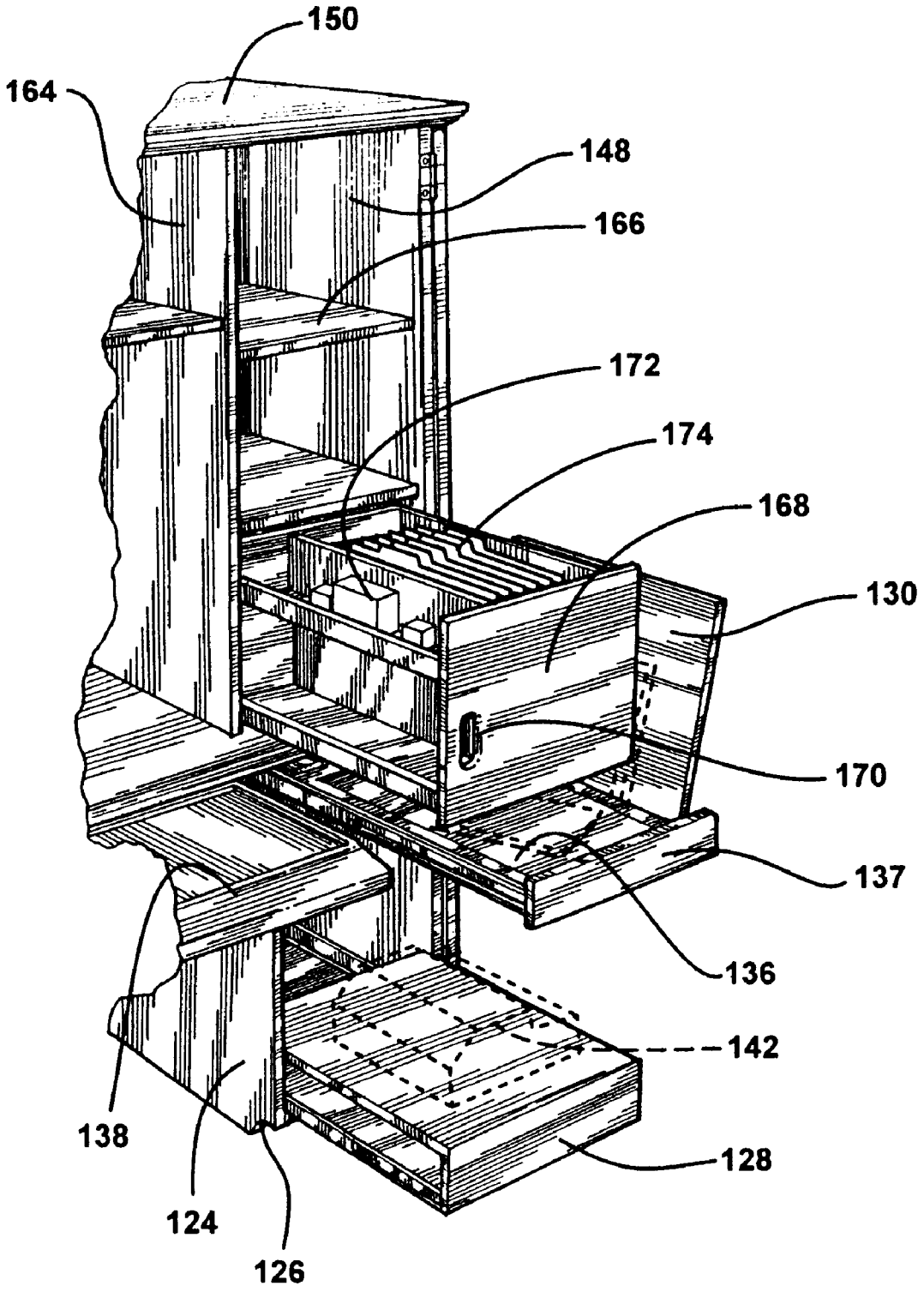
FIG. 17 is a fragmentary front, left perspective view thereof, in an open position.

An interior vertical support panel 124 extends downward from the worksurface or desktop 106, adjacent the kneehole opening 122 (FIGS. 14 and 15). A front lower edge 126 of panel 124 is recessed to hide the panel 124 from view, when the doors 112 are closed. A slide out work unit 125, a shelf 127, and a slide out printer drawer 128 may be mounted between panel 124 and outer panel 108. The slide out work unit 125 includes a pivoting top 130 that is pivotally mounted between two side panels 132 at a rear edge of the slide out work unit (FIGS. 14–17). Top 130 pivots upward and rests at an angle to serve as a work stand. When top 130 is pivoted upward, a work surface 136 that is positioned under the top 130 is revealed.

A slide out keyboard drawer 138 may also be positioned under the desktop 106 at the top of kneehole opening 122. A computer keyboard 140 can be mounted in tray 138. A printer 142 can be mounted on slide out printer tray 128.

The upper storage unit or hutch 104 has an appearance similar to lower desk unit 102 and includes a pair of doors 144 mounted with hinges 146 at front edges of side panels 148. A top 150 with an edge molding is Provided at the top of the hutch 104. Both the hutch 104 and the desk 102 have back panels 152 and 155, respectively, that close the back of the unit 100. Like the desk unit doors 112, hutch doors 144 have an appearance of door panels 152 that are pivotally mounted on a fixed side frame 154 and below a face panel 156 that extends across the top of the front of the hutch (FIG. 13). The panels 152, 154, and 156 are all part of the door 144 and open the complete interior of the unit when the doors 144 are pivoted to an open position (FIG. 14). The doors 144 in the upper storage unit 104 also appear to have a center strip 160 that creates an impression of a fixed center frame to which the doors are latched. In fact, the center strip 160 comprises part of one of the doors 144 and moves out of the way to completely open the interior hutch 104 when the doors 14 are opened with handles 161. When the doors 144 are open, they lay against the side panels 148 in an unobtrusive manner that does not interfere with the function or the appearance of the unit 100, when it is being used as a desk (FIGS. 14–17). Hinges 114 and 146 permit full pivotal movement of the doors 144, all the way around to the side panel 148.

The interior of hutch 104 may include a center panel 164 and a plurality of shelves 166, extending between center panel 164 and either side panel 148 of the hutch. The shelves 166 may be fixed or adjustable, as will be understood by one having ordinary skill in the art. A pull out file cabinet 168 may also be mounted in the hutch 104, and may be provided with a hand opening or handle 170 (FIGS. 14–17). The file drawer may include a raised storage shelf 172 on an inner edge of the file drawer, with file storage 174 in a rear portion of the file drawer.

As specifically shown, and not limiting the invention, the left side of the desk 102, over the kneehole space 122, comprises a writing surface or work space 176. This can also serve as a receptacle for a computer monitor 178. A chair with a fold down back 180 may be conveniently stored in the kneehole opening 122, within the concealed desk 100, when not in use.

Thus, when the doors 112 and 144 are open, the desk unit 100 provides a fully functioning work area or a computer desk. And, when the doors 112 and 144 are closed, the fact that the unit is a desk is concealed and the unit has the appearance of a traditional home cabinet.

Figure 18:
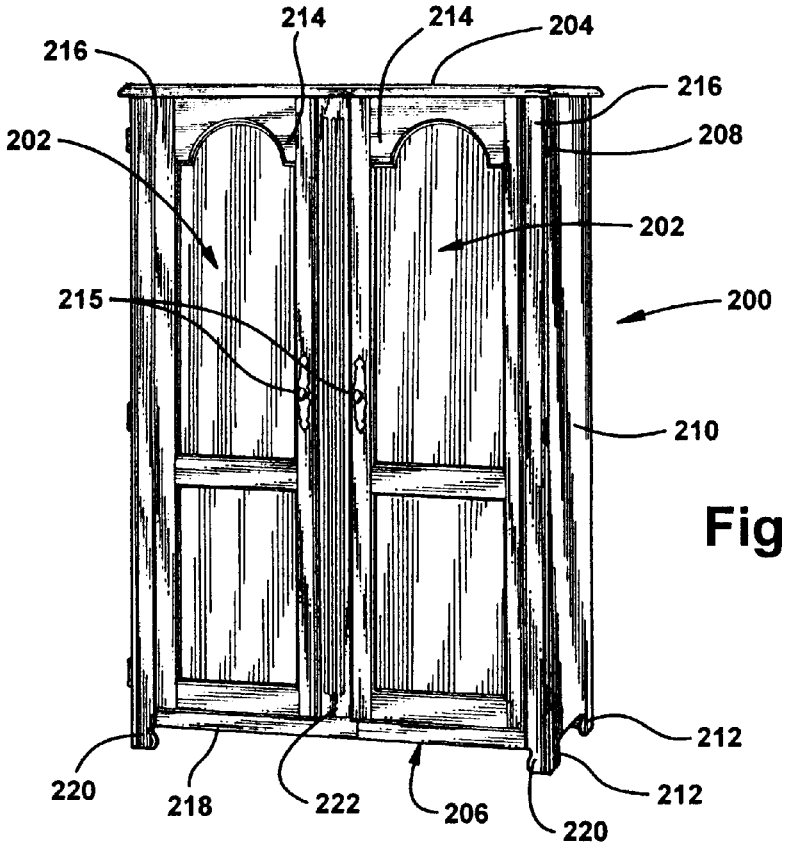
FIG. 18 is a front, right perspective view of a third embodiment of the invention, in a closed position.
Figure 19:
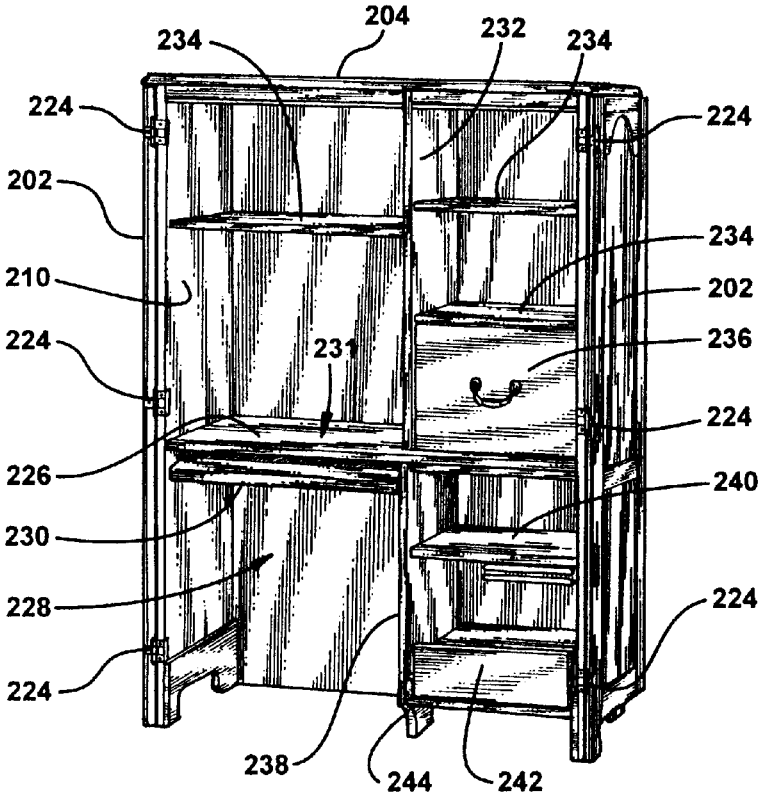
FIG. 19 is the view of FIG. 18 in an open position.

Yet a third embodiment 200 of the present invention is shown in drawing FIGS. 18 and 19. The concealed desk 200 is similar to the other units 10 and 100, most notably excepting that it has full length doors 202 extending from a top 204 to a supporting floor. The doors 202 are mounted with hinges 208 at the front edges of side panels 210, which also run the full height of the unit. Side panels 210 include legs 212 at the front and rear of the side panels.

As in the previous embodiment, doors 202 have a facade that appear as if smaller door panels 214 are hinged on a fixed frame comprising vertical side strips 216, and a fixed lower strip 218 that extends between side strips 216. Further two feet 220 appear to be fixed in position at the bottom of side strips 216. The facade doors 214 appear to latch with a fixed vertical center strip 222 at the middle of the cabinet. In reality, the vertical side strips 216, the lower strip 218, and the center strip 222 all constitute part of the moving doors, with center strip 222 constituting a part of the left door in FIG. 18. Thus, when the doors 202 are opened, the entire interior of the cabinet is opened, revealing the desk unit shown in FIG. 19, with unobstructed access in the kneehole 228.

When doors 202 are opened, they most preferably fold against the side panels 210 of the cabinet in an out-of-the-way position. The doors 202 may be mounted on hinges 224 at the front side edges of the side panels 210 in a manner similar to the previous embodiments. When the doors 202 are opened by means of door handles 215, the doors may fold against the sides of the panels.

The interior of the desk unit comprises a desktop writing surface 226 with a kneehole opening 228 positioned below the writing surface. The writing surface or worksurface 226 can also be used as a location for positioning a computer monitor. A slide out computer tray 230 is mounted under work surface 226. A center vertical support panel 232 is positioned between side panels 210 and supports a number of shelves 234, which may be adjustable in the manner described above. A pull out file cabinet 236 is mounted at the lower right hand corner of the top of the desk. Writing surface 226 is a portion of a panel 231 that extends the full width of the cabinet between the side panels and serves as the desktop for the unit.

A lower central panel member 238 extends downward from the underside of the desktop 231 and supports one side of the pull out keyboard tray on the left side and supports a fixed shelf 240 and a pull out printer shelf 242 on the right side of panel 238. As previously, a front lower edge 244 of panel 238 is recessed so that the panel is not readily apparent from the front of the cabinet (as shown in FIG. 18).

This embodiment of the present invention serves much the same function as the previous embodiments, with the exception that the exterior of the cabinet employs two full length doors and a full length cabinet that is not interrupted by an outstanding peripheral edge of a desktop. Thus, while the other embodiments create the impression of two section units or a unit having upper and lower sections connected together, this embodiment gives the impression of a single cabinet with full length doors, such as an armoire.

It will be understood by one having ordinary skill in the art and by those who practice the invention, that various modifications and improvements may be made without departing from the spirit of the disclosed concept. Various relational terms, including left, right, front, back, top, and bottom, for example, are used in the claims only to convey relative positioning of various elements of the claimed invention. The scope of protection afforded is to be determined by the claims and by the breadth of interpretation allowed by law.

I claim:

1. A concealed desk having a front and an opposing back, and opposing first and second ends, the desk comprising:

a desktop;

a first panel located near the first end, the first panel extending between the desktop and a supporting floor, the first panel also extending between the front and the back;

a second panel located near the second end, the second panel extending between the desktop and the supporting floor, extending between the front and the back, and being spaced apart from the first panel to define a kneehole opening between the first and the second panels, the kneehole opening extending from the front toward the back; and a door connected with one of the first and the second panels, to hinge between a closed position, wherein the door overlays and covers the kneehole opening and the desk is concealed by an appearance of a storage cabinet other than a desk, and an open position, wherein the kneehole opening and the desk are exposed and accessible to a user.

2. The desk of claim 1, further including a hutch that extends generally upward from the desktop.

3. The desk of claim 2, wherein the hutch has a hutch interior and has a hutch door connected with the hutch to hinge between a closed position, wherein the hutch door overlays and covers at least a portion of the hutch interior to conceal the at least a portion of the hutch interior, and an open position, wherein hutch interior is exposed and accessible to a user.

4. The desk of claim 2, wherein the hutch has a hutch interior and wherein the door extends upward and is connected with the hutch to hinge between the closed position, wherein the door overlays and covers at least a portion of the hutch interior to conceal the at least a portion of the hutch interior, and the open position, wherein hutch interior is exposed and accessible to a user.

5. The desk of claim 4, further including a storage unit adjacent one of the first and the second panels, the storage unit extending from the one panel toward the other of the first and the second panels, so the storage unit is covered and concealed by the door, when the door is in the closed position, and is exposed and accessible to a user, when the door is in the open position.

6. The desk of claim 2, further including a storage unit adjacent one of the first and the second panels, the storage unit extending from the one panel and away from the door, so the storage unit is exposed and accessible to a user, when the door is in either of the closed or the open positions.

7. The desk of claim 1, further including a storage unit adjacent one of the first and the second panels, the storage unit extending from the one panel toward the other of the first and the second panels, so the storage unit is covered and concealed by the door, when the door is in the closed position, and is exposed and accessible to a user, when the door is in the open position.

8. The desk of claim 1, further including a storage unit adjacent one of the first and the second panels, the storage unit extending from the one panel and away from the door, so the storage unit is exposed and accessible to a user, when the door is in either of the closed or the open positions.

9. The desk of claim 8, wherein the storage unit has a panel connected with the storage unit to move between a closed position, wherein the storage unit is concealed and the panel presents an appearance of one of a door and a drawer, and an open position, wherein the storage unit is exposed and accessible to a user.

10. A concealed desk having a front and an opposing back, and opposing first and second ends, the desk comprising:

first and second panels that are spaced apart and oriented generally parallel with one another;

a worksurface supported above a floor by the panels, the worksurface and the panels defining a kneehole opening between the panels and under the worksurface, the kneehole extending from the front toward the back; and a door that is connected with one of the panels, to hinge between a closed position, wherein the door overlays and covers the kneehole opening and the desk is concealed by an appearance of a storage cabinet other than a desk, and an open position, wherein the kneehole opening and the desk are exposed and accessible to a user.

11. The desk of claim 10, further including a hutch that extends generally upward from the worksurface.

12. The desk of claim 11, wherein the hutch has a hutch interior and has a hutch door connected with the hutch to hinge between a closed position, wherein the hutch door overlays and covers at least a portion of the hutch interior to conceal the at least a portion of the hutch interior, and an open position, wherein hutch interior is exposed and accessible to a user.

13. The desk of claim 11, wherein the hutch has a hutch interior and wherein the door extends upward and is connected with the hutch to hinge between the closed position, wherein the door overlays and covers at least a portion of the hutch interior to conceal the at least a portion of the hutch interior, and the open position, wherein hutch interior is exposed and accessible to a user.

14. The desk of claim 13, further including a storage unit adjacent one of the first and the second panels, the storage unit extending from the one panel toward the other of the first and the second panels, so the storage unit is covered and concealed by the door, when the door is in the closed position, and is exposed and accessible to a user, when the door is in the open position.

15. The desk of claim 11, further including a storage unit adjacent one of the first and the second panels, the storage unit extending from the one panel and away from the door, so the storage unit is exposed and accessible to a user, when the door is in either of the closed or the open positions.

16. The desk of claim 10, further including a storage unit adjacent one of the first and the second panels, the storage unit extending from the one panel toward the other of the first and the second panels, so the storage unit is covered and concealed by the door, when the door is in the closed position, and is exposed and accessible to a user, when the door is in the open position.

17. The desk of claim 10, further including a storage unit adjacent one of the first and the second panels, the storage unit extending from the one panel and away from the door, so the storage unit is exposed and accessible to a user, when the door is in either of the closed or the open positions.

18. The desk of claim 17, wherein the storage unit has a panel connected with the storage unit to move between a closed position, wherein the storage unit is concealed and the panel presents an appearance of one of a door and a drawer, and an open position, wherein the storage unit is exposed and accessible to a user.

19. A concealed desk having a front and an opposing back, and opposing first and second ends, the desk comprising:

first and second panels that are spaced apart, generally vertical, and oriented generally parallel with one another, each of the panels extending from a supporting floor to a top end;

a top supported by the panels at the top end;

a worksurface supported above a floor by the panels, the worksurface and the panels defining a kneehole opening between the panels and under the worksurface, the kneehole extending from the front toward the back, the panels extending generally upward beyond the worksurface to the top; and a door that is connected with one of the panels, to hinge between a closed position, wherein the door overlays and covers the kneehole opening and the desk is concealed by an appearance of a storage cabinet other than a desk, and an open position, wherein the kneehole opening and the desk are exposed and accessible to a user.

20. The desk of claim 19, further including a storage unit adjacent one of the first and the second panels, the storage unit extending from the one panel and away from the door, so the storage unit is exposed and accessible to a user, when the door is in either of the closed or the open positions.

21. The desk of claim 19, further including a storage unit adjacent one of the first and the second panels, the storage unit extending from the one panel toward the other of the first and the second panels, so the storage unit is covered and concealed by the door, when the door is in the closed position, and is exposed and accessible to a user, when the door is in the open position.

* * * * *